US005462209A

United States Patent [19]

Foster et al.

[11] Patent Number: 5,462,209

[45] Date of Patent: Oct. 31, 1995

[54] TRIGGER SPRAYER OPERABLE IN UPRIGHT, DOWNTURNED AND INVERTED POSITIONS

[75] Inventors: Donald D. Foster, St. Charles; Philip L. Nelson, Ellisville, both of Mo.

[73] Assignee: Contico International, Inc., St. Louis, Mo.

[21] Appl. No.: 273,951

[22] Filed: Jul. 12, 1994

Related U.S. Application Data

[63] Continuation-in-part of Ser. No. 242,281, May 13, 1994.

[51] Int. Cl.[6] ..... B67D 5/42

[52] U.S. Cl. ..... 222/376; 222/383.1

[58] Field of Search ..... 222/376, 385, 222/481, 481.5, 482, 321.1–321.9, 383.1–383.3

[56] References Cited

U.S. PATENT DOCUMENTS

| | | | |
|---|---|---|---|
| 1,484,920 | 2/1924 | Wolfe | 222/376 X |
| 1,735,784 | 11/1929 | Olson | 222/376 X |
| 2,812,117 | 11/1957 | Butkus et al. | 222/481 X |
| 2,851,201 | 9/1958 | Poitras et al. | 222/481 |
| 3,315,693 | 4/1967 | Braun | 137/43 |
| 3,379,136 | 4/1968 | Corsette | 222/321 X |
| 3,545,488 | 12/1970 | Venus, Jr. | 222/376 X |
| 4,174,790 | 10/1979 | Nozawa et al. | 222/321 |
| 4,274,560 | 6/1981 | Cater | 222/321 |
| 4,277,001 | 7/1981 | Nozawa | 222/324 |
| 4,284,211 | 8/1981 | Meshberg | 222/182 |
| 4,726,386 | 2/1988 | Schultz | 132/79 |
| 4,735,347 | 4/1988 | Schultz et al. | 222/321 |
| 4,775,079 | 10/1988 | Grothoff | 222/321 |
| 4,895,279 | 1/1990 | Schultz | 222/321 |
| 4,942,985 | 7/1990 | Schultz | 222/376 |
| 4,991,746 | 2/1991 | Schultz | 222/321 |
| 5,119,974 | 6/1992 | Mann | 222/376 |
| 5,125,543 | 6/1992 | Rohrabacher et al. | 222/211 |
| 5,183,186 | 2/1993 | Delaney, Jr. | 222/211 |
| 5,192,007 | 3/1993 | Blomquist | 222/376 |
| 5,195,664 | 3/1993 | Rhea | 222/464 |
| 5,222,636 | 6/1993 | Meuresch | 222/321 |
| 5,277,559 | 1/1994 | Schultz | 417/540 |
| 5,341,967 | 8/1994 | Silvenis | 222/376 |

FOREIGN PATENT DOCUMENTS

| | | | |
|---|---|---|---|
| 2632662 | 1/1977 | Germany . | |
| 3929064 | 1/1991 | Germany | 222/376 |
| 287342 | 3/1953 | Switzerland | 222/376 |

*Primary Examiner*—Andres Kashnikow
*Assistant Examiner*—Kenneth Bomberg
*Attorney, Agent, or Firm*—Rogers, Howell & Haferkamp

[57] ABSTRACT

A manually operable trigger sprayer is capable of dispensing a liquid with the trigger sprayer held in an upright orientation, in a downturned orientation and in an inverted orientation. In operation of the trigger sprayer in all three orientation positions, the liquid in the container to which the trigger sprayer is attached is prevented from leaking through the vent passage of the trigger sprayer.

23 Claims, 1 Drawing Sheet

TRIGGER SPRAYER OPERABLE IN UPRIGHT, DOWNTURNED AND INVERTED POSITIONS

This application is a continuation-in-part of application Ser. No. 08/242,281, filed May 13, 1994.

BACKGROUND OF THE INVENTION (1) Field of the Invention

The present invention pertains to a manually operable trigger sprayer that is capable of dispensing a liquid with the trigger sprayer held in an upright orientation, in a downturned orientation and in an inverted orientation. In operation of the trigger sprayer in all three orientation positions, the liquid in the container to which the trigger sprayer is attached is prevented from leaking through the vent passage of the trigger sprayer.

(2) Description of the Related Art

Generally, a trigger sprayer of the type to which the present invention pertains is operable only in an upright orientation of the trigger sprayer. If the trigger sprayer is positioned in a downturned orientation the dispense liquid from the sprayer nozzle directly downward, liquid within the container attached to the trigger sprayer will often leak through the vent passage of the trigger sprayer. Also, depending on the amount of liquid in the container, with the trigger sprayer positioned in a downturned orientation, the dip tube extending from the trigger sprayer into the container interior may be raised above the level of liquid in the container. With the dip tube raised out of the liquid, the trigger sprayer will dispense the liquid remaining in the dip tube as its trigger is manually reciprocated, but once the liquid in the dip tube has been dispensed from the trigger sprayer, any further manual reciprocation of the trigger will result in only air in the container being dispensed through the trigger sprayer. Likewise, when the trigger sprayer is operated in an inverted orientation with the sprayer and container held upsidedown, the liquid of the container will leak through the vent passage of the sprayer and the end of the dip tube will project above the level of liquid in the container resulting in operation of the sprayer only dispensing air once the liquid in the dip tube has been pumped through the sprayer.

Several trigger sprayers have been designed for operation in both upright and inverted orientations of the trigger sprayers. Their designs prevent the liquid in the container from leaking through the vent passage of the trigger sprayer when it is held in an inverted orientation. These designs also continue to supply liquid to the pump chamber of the trigger sprayer when it is held in an inverted orientation even with the end of the dip tube of the trigger sprayer projecting above the level of the liquid in the container. However, these trigger sprayers are designed to operate in only upright and inverted orientations. When it is desired to operate the trigger sprayer in a downturned orientation with the nozzle of the trigger sprayer pointed directly downward, the liquid of the container will often leak through the vent passage of the trigger sprayer. Furthermore, in many trigger sprayers designed for operation in an inverted orientation, attempting to operate the trigger sprayer in a downturned orientation will result in the pump of the trigger sprayer sucking air from the container instead of the liquid.

SUMMARY OF THE INVENTION

The trigger sprayer of the present invention overcomes shortcomings of trigger sprayers designed for operation in upright and inverted orientations by providing a trigger sprayer design that enables the trigger sprayer to dispense liquid from a container in upright, downturned and inverted orientations while preventing liquid of the container from leaking through the trigger sprayer vent passage and also preventing the pump of the trigger sprayer from sucking air when operated in the upright, downturned or inverted orientations.

The trigger sprayer of the invention has a dispenser head including many of the features typically found in trigger sprayers. These features include a fluid discharge passage containing a fluid spinner for imparting a spin to fluid discharged from the trigger sprayer producing a desired spray pattern of the discharged fluid, a pump cylinder, a vent cylinder, a pump piston positioned for reciprocating movement in the pump cylinder and a vent piston connected to the pump piston and positioned for reciprocating movement in the vent cylinder. A trigger is connected to the dispenser head for pivoting movement and is operatively connected to the pump and vent systems. A suction passage extends through the dispensing head communicating the interior of the pump cylinder with the fluid discharge passage and with a dip tube extending from the dispenser head into the liquid container to which the dispenser head is attached.

Unlike conventional trigger sprayers, the trigger sprayer of the present invention has a vent passage extending from the interior of the vent cylinder to the interior of the container attached to the dispenser, where the vent passage includes separate first and second valve seats and contains a ball valve within the vent passage. When the trigger sprayer is operated in its upright orientation, the vent ball valve is displaced from both the first and second valve seats and the vent passage is open providing venting communication between the interior of the container attached to the trigger sprayer dispenser head and the exterior environment of the dispenser head. When the trigger sprayer dispenser head is turned to its downturned orientation with the nozzle pointed directly downward, the vent ball valve moves in the vent passage and seats over the first valve seat preventing communication through the vent passage and thereby preventing the liquid within the container from leaking through the vent passage and from the dispenser head. When the dispenser head is turned to its inverted orientation, the vent ball valve moves in the vent passage and seats over the second valve seat, again blocking communication through the vent passage and preventing the liquid in the container from leaking through the vent passage and from the dispenser head.

The suction passage of the dispenser head which includes the dip tube depending from the dispenser head has a check valve positioned in the passage as is typical of many trigger sprayers. The check valve includes a check ball valve that operates to permit only the flow of liquid from the container up through the suction passage, by the check valve and to the interior of the pump cylinder on the expansion stroke of the pump piston in the cylinder, but prevents backflow through the suction passage toward the container on the compression stroke of the pump piston in the pump cylinder. The trigger sprayer dispenser head of the invention also includes a bypass passage that communicates with the suction passage at a position on the dispenser head that locates the bypass passage proximate to the top of the container attached to the dispenser head, The bypass passage provides fluid communication between the suction passage and the container interior at the top of the container, The bypass passage includes a single valve seat and a ball valve that seats over the valve seat blocking communication through the bypass passage when the dispenser head is in its upright orientation and when the dispenser head is in its downturned orientation, Thus, the ball valve of the bypass passage prevents the dispenser head pump from sucking air from the top of the container interior through the bypass passage when the dispenser head is positioned in its upright orientation and when it is positioned in its downturned orientation, However, when the dispenser head is positioned in its inverted orientation the bypass ball valve unseats from the valve seat of the bypass passage permitting communication through the bypass passage. This enables the liquid of the inverted container to pass through the bypass passage to the suction passage providing the liquid to the pump chamber when the dispenser head is inverted and the end of the dip tube extends above the level of liquid in the container,

BRIEF DESCRIPTION OF THE DRAWINGS

Further objects and features of the present invention are revealed in the following detailed description of the preferred embodiment of the invention and in the drawing figures wherein.

DESCRIPTION OF THE PREFERRED EMBODIMENT

The novel construction of the trigger sprayer of the present invention enables the trigger sprayer to be operated when positioned in an upright orientation, in a downturned orientation and in an inverted orientation. What is meant by the upright orientation is that the trigger sprayer is positioned in an orientation where the container attached to the dispensing head of the sprayer is suspended beneath the sprayer and the spray pattern discharged from the nozzle of the sprayer is directed forwardly out from the sprayer. What is meant by the downturned orientation is that the nozzle of the trigger sprayer is pointed downwardly so that the spray discharged from the sprayer is directed vertically downward and the liquid container attached to the dispensing head is positioned side by side with the dispensing head. What is meant by the inverted orientation of the trigger sprayer is that the trigger sprayer and its attached liquid container are positioned upside-down with the container over the trigger sprayer.

Figure 4:
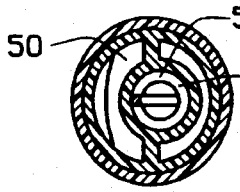
FIG. 4 is an insection view taken along the line 4—4 of FIG. 1.
Figure 1:
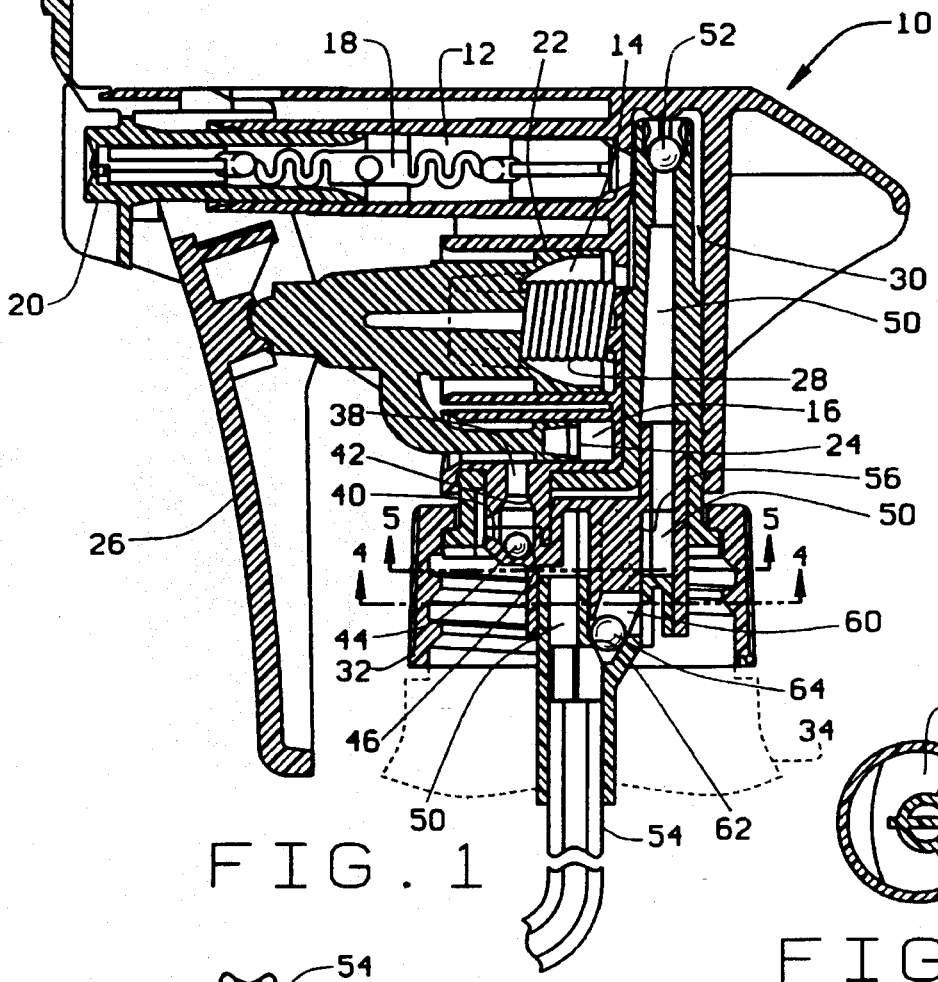
FIG. 1 is an insection view of the trigger sprayer of the present invention shown with the trigger sprayer in the upright orientation.
Figure 5:
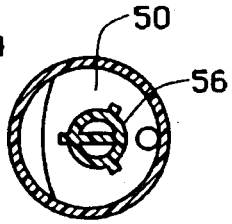
FIG. 5 is an insection view taken along the line 5—5 of FIG. 1.

Referring to FIG. 1, the trigger sprayer of the present invention is comprised of a dispenser head 10 having a fluid discharge passage 12, a pump cylinder 14 and a vent cylinder 16 formed therein. A fluid spinner 18 is positioned in the fluid discharge passage 12 and a spray nozzle 20 inserted at the end of the discharge passage. The fluid spinner 18 imparts a spin to fluid pumped through the discharge passage 12 and out the spray nozzle 20 as is typical of many trigger sprayers. A pump piston 22 is received for reciprocating movement in the pump cylinder 14 and a vent piston 24 connected to the pump piston is received for reciprocating movement in the vent cylinder 16. A trigger 26 is mounted to the dispenser head 10 for pivoting movement relative thereto and is operatively connected to the pump piston 22 and vent piston 24 for removing both pistons into their respective cylinders on manual manipulation of the trigger 26. A spring 28 within the pump cylinder 14 biases both the pump and vent pistons on their return strokes out of their respective cylinders. A vertical passage 30 extends upwardly through the dispenser head 10 communicating the fluid discharge passage 12 with the pump cylinder 14. An internally threaded cap 32 is provided at the bottom of the dispenser head 10 for attaching the dispenser head to a liquid filled container 34 (shown in dashed lines in the drawings). The features of the trigger sprayer of the invention described thus far are typical in many trigger sprayers.

The dispenser head 10 is also formed with a vent passage 38 extending between the interior of the vent cylinder 16 and the container interior when the dispenser head is attached to a liquid container. The vent passage 38 is formed with a first valve seat 40 and a second valve seat 42 that are separated from each other at different areas of the vent passage. The vent passage contains a vent ball valve 44 dimensioned to seat on and block both the first and second valve seats 40, 42. The vent passage also includes a recessed surface 46 to receive the ball valve 44 positioning the ball valve away from both the first and second valve seats 40, 42 when the dispensing head 10 of the trigger sprayer is positioned in the upright orientation shown in FIG. 1.

A suction passage 50 extends downward through the dispenser head 10 from a check valve 52 at the top of the suction passage to a dip tube 54 forming a part of the bottom of the suction passage. The check valve 52 operates in the same manner as check valves of typical trigger sprayers and permits fluid flow only through the suction passage 50 and to the pump cylinder 14 in response to the retraction stroke of the pump piston 22 in the cylinder. The check valve prevents fluid flow into the suction passage 50 from the pump cylinder 14 when the pump piston is reciprocated in its compression stroke in the pump cylinder. This causes the liquid forced out of the pump cylinder 14 by the compression stroke of the pump piston 22 to unseat the valve of the fluid spinner 18 and to pass through the fluid discharge passage 12 dispensing as a spray from the nozzle 20. This operation of the check valve 52 occurs whether the dispenser head 10 of the trigger sprayer is positioned in the upright orientation shown in FIG. 1, the inverted orientation shown in FIG. 2, or the downturned orientation shown in FIG. 3.

The suction passage 50 extends from the check valve 52 around a connector column 56 and to the dip tube 54. Although not shown in the drawing figures, the configuration of the dip tube 54 is such that it curves to the forward bottom edge of the container 34 to which the trigger sprayer is attached as it extends into the container and toward its distal end. This enables the distal end of the dip tube to extend into the liquid of the container when the trigger sprayer and container are positioned in the downturned orientation even when the amount of liquid remaining in the container is very small.

A bypass passage 60 extends between the suction passage 50 and the interior of the container 34 attached to the trigger sprayer. As seen in the drawing figures, the bypass passage 60 extends between the suction passage 50 and the container interior at a position proximate to the top of the container. The bypass passage 60 is formed with a single valve seat 62 and contains a bypass ball valve 64. The configuration of the bypass passage is such that the bypass ball valve 64 cannot exit the passage regardless of the orientation of the trigger sprayer. The bypass ball valve 64 is dimensioned to seat over the bypass passage valve seat 62 and block communication through the bypass passage when the dispenser head 10 of the trigger sprayer is positioned in the upright orientation and when it is positioned in the downturned orientation.

In operation of the trigger sprayer dispenser head 10 shown in the upright orientation in FIG. 1, the vent ball valve 44 is positioned on the recessed surface 46 of the vent passage, thereby unblocking the vent passage. This enables the interior of the container 34 attached to the dispenser head 10 to vent through the vent passage 38 and the vent cylinder 16 on the compression stroke of the pump piston 22. On the return stroke of the pump piston, the suction created in the pump cylinder 14 draws liquid up through the dip tube 54, through the suction passage 50 unseating the check valve 52 and into the pump cylinder 14. On the subsequent compression stroke of the pump piston 22 the fluid contained in the pump cylinder 14 is forced out of the cylinder and unseats the valve of the fluid spinner 18. The fluid passes through the discharge passage 12 and is dispensed as a spray from the spray nozzle 20. In the upright orientation of the dispenser head, the bypass ball valve 64 seats over the bypass passage valve seat 62 and prevents the suction created in the suction passage 50 from drawing air from the top of the container 34 through the bypass passage. Thus, the suction created in the suction passage 50 by operation of the pump piston 22 draws liquid from the container up through the dip tube 54 and suction passage 50 into the pump cylinder 14 while the container interior is vented through the vent passage 38.

Figure 2:
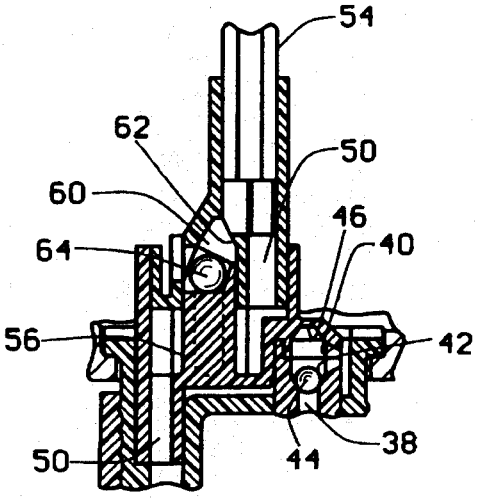
FIG. 2 is a partial insection view of the vent passage and bypass passage of the trigger sprayer of the invention shown with the trigger sprayer in an inverted orientation.
Figure 3:
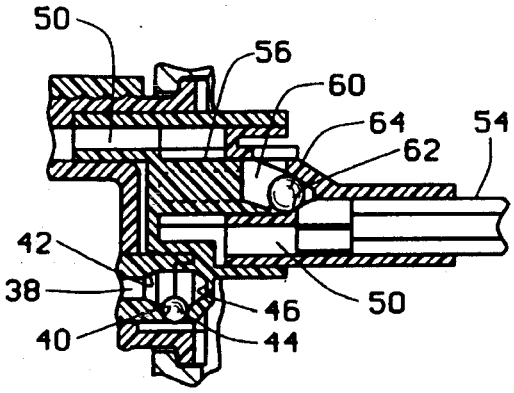
FIG. 3 is a partial insection view of the vent passage and bypass passage of the trigger sprayer of the invention shown with the trigger sprayer positioned in the downturned orientation.

In operation of the trigger sprayer dispenser head 10 with the dispenser head positioned in the inverted orientation shown in FIG. 2, the vent ball valve 44 seats over the second valve seat 42 of the vent passage thereby blocking the passage and preventing the liquid of the container from leaking through the passage and from the dispenser head. The bypass passage ball valve 64 unseats from the bypass passage valve seat 62 and thereby unblocks the bypass passage 60. The liquid in the inverted container may then pass through the bypass passage 60 to the suction passage 50 thereby supplying the liquid to the pump cylinder 14 even though the distal end of the dip tube 54 is positioned above the level of liquid in the container. On the compression stroke of the pump piston 22, the suction passage check valve 52 seats in the same manner as when the trigger sprayer is operated in the upright orientation, preventing the passage of liquid from the pump cylinder 14 and back through the suction passage. The liquid forced out of the pump cylinder 14 unseats the fluid spinner valve and passes through the discharge passage 12 and is dispensed from the trigger sprayer spray nozzle 20. On the retraction stroke of the pump piston 22 the suction created unseats the suction passage check valve 52 drawing liquid from the suction passage and the bypass passage 60. The pressure head of the liquid contained in the container in its inverted orientation maintains the level of liquid in the inverted dip tube 54 at the same level as the liquid in the container and thereby prevents the pump piston 22 from drawing air through the dip tube.

In operation of the trigger sprayer dispenser head 10 positioned in its downturned orientation, the vent ball valve 44 seats over the first valve seat 40 of the vent passage blocking communication through the vent passage and preventing the liquid of the container from leaking through the vent passage and from the vent cylinder of the dispenser head. The bypass ball valve 64 seats over the bypass passage valve seat 62 blocking communication through the bypass passage. Should the level of liquid in the container decrease below the bypass passage 60 with the dispenser head and container positioned in the downturned orientation the blocking of the bypass passage by the bypass ball valve seating over the bypass passage valve seat prevents the pump piston 62 from drawing air from the container interior. The compression stroke of the pump piston 22 operates in the same manner as described above with regard to the dispenser head being positioned in the upright and inverted orientations. The pressure created in the fluid contained in the pump cylinder 14 causes the suction passage check valve 52 to seat directing the fluid through the discharge passage 12 and the spray nozzle 20. On the expansion stroke of the pump piston 22, the vacuum created in the pump cylinder 14 unseats the suction passage check valve 52 and draws liquid through the suction passage 50 and the dip tube 54 which, as explained earlier, curves as it extends to its distal end (not shown) positioning its distal end at the forward, bottom corner of the liquid container. Thus, the return stroke of the pump piston 22 draws the liquid remaining in the container through the dip tube 54 and the suction passage 50 to the pump cylinder 14.

While the present invention has been described by reference to a specific embodiment, it should be understood that modifications and variations of the invention may be constructed without departing from the scope of the invention defined in the following claims. For example, the vent ball valve and bypass passage ball valve may be replaced by flapper valves that seat over the valve seats of the vent passage and bypass passage to block communication through those passages.

What is claimed is:

1. A trigger sprayer for dispensing liquid from a container in an upright orientation, a downturned orientation and an inverted orientation of the trigger sprayer, the trigger sprayer comprising:

a dispenser head for dispensing liquid from the container to which the dispenser head is adapted to be attached, the dispenser head having a vent passage providing venting communication of an interior of the container with an exterior environment of the dispenser head through the vent passage when the dispenser head is positioned in the upright orientation, and the dispenser head having means for blocking communication of the interior of the container with the exterior environment of the dispenser head through the vent passage both when the dispenser head is positioned in the downturned orientation and when the dispenser head is positioned in the inverted orientation while the trigger sprayer is dispensing liquid.

2. The trigger sprayer of claim 1, wherein:

the dispenser head has a pump and a suction passage for directing liquid from the container to the pump when the dispenser head is positioned in the upright orientation, and the vent passage is separate from and does not communicate with the suction passage.

3. The trigger sprayer of claim 2, wherein:

the suction passage directs liquid from the container interior to the pump when the dispenser head is positioned in the downturned orientation and when the dispenser head is positioned in the inverted orientation.

4. The trigger sprayer of claim 2, wherein:

a dip tube is connected to the dispenser head and the pump draws liquid from the container through the dip tube and then through the suction passage when the dispenser head is positioned in the upright orientation and when the dispenser head is positioned in the downturned orientation.

5. The trigger sprayer of claim 4, wherein:

the dispenser head has a bypass passage extending between the suction passage and the container interior bypassing the dip tube, and the bypass passage includes means for blocking the bypass passage when the dispenser head is positioned in the upright orientation and when the dispenser head is positioned in the downturned orientation, and for unblocking the bypass passage when the dispenser head is positioned in the inverted orientation.

6. The trigger sprayer of claim 5, wherein:

the means for blocking the bypass passage includes a valve seat in the bypass passage and a valve element in the bypass passage, the valve seat is positioned in the bypass passage so that the valve element sits on the valve seat and blocks the bypass passage both when the dispenser head is positioned in the upright orientation and when the dispenser head is positioned in the downturned orientation, and so that the valve element is displaced from the valve seat unblocking the bypass passage when the dispenser head is positioned in the inverted orientation.

7. The trigger sprayer of claim 6, wherein:

the valve element is a ball valve.

8. The trigger sprayer of claim 2, wherein:

the suction passage has opposite first and second ends, the first end of the suction passage is proximate the pump and the second end of the suction passage is positioned proximate a bottom of the liquid container when the dispenser head is connected to the container, and the dispenser head has a bypass passage that extends from the suction passage, intermediate the suction passage first and second ends, to the interior of the liquid container when the dispenser head is connected to the container, and the bypass passage has means for blocking the bypass passage in response to the dispenser head being positioned in the upright orientation and for blocking the bypass passage in response to the dispenser head being positioned in the downturned orientation, and for unblocking the bypass passage in response to the dispenser head being positioned in the inverted orientation.

9. The trigger sprayer of claim 8, wherein:

the means for blocking the bypass passage includes a valve seat in the bypass passage and a valve element that sits on the valve seat in response to the dispenser head being positioned in the upright orientation and also sits on the valve seat in response to the dispenser head being positioned in the downturned orientation, and is displaced from the valve seat in response to the dispenser head being positioned in the inverted orientation.

10. The trigger sprayer of claim 9, wherein:

the valve element is a ball valve.

11. The trigger sprayer of claim 1, wherein:

the vent passage extends between opposite first and second ends of the vent passage and the first end of the vent passage opens to the exterior environment of the dispenser and the second end of the vent passage opens to the interior of the container when the dispenser head is connected to the container;

the dispenser head has a pump chamber and a suction passage that extends between opposite first and second ends of the suction passage, the first end of the suction passage opens to the pump chamber and the second end of the suction passage opens to the container interior when the dispenser is connected to the container, and the dispenser head has a bypass passage that extends between opposite first and second ends of the bypass passage, the first end of the bypass passage opens to the suction passage and the second end of the bypass passage opens to the container interior when the dispenser is connected to the container, and the vent passage is separate from and does not communicate with the suction passage and the bypass passage.

12. The trigger sprayer of claim 11, wherein:

the dispenser head has means for blocking the bypass passage in response to the dispenser head being positioned in the upright orientation and means for blocking the bypass passage in response to the dispenser head being positioned in the downturned orientation and means for unblocking the bypass passage in response to the dispenser head being positioned in the inverted orientation.

13. The trigger sprayer of claim 12, wherein:

the means for blocking the bypass passage includes a valve seat in the bypass passage and a valve element that sits over the valve seat in response to the dispenser head being positioned in the upright orientation and in response to the dispenser head being positioned in the downturned orientation, and is displaced from over the valve seat in response to the dispenser head being positioned in the inverted orientation.

14. The trigger sprayer of claim 1, wherein:

the means for blocking communication through the vent passage includes a valve seat in the vent passage and a valve element that sits over the valve seat to block communication through the valve seat and thereby block communication through the vent passage.

15. The trigger sprayer of claim 14, wherein:

the valve element is a ball valve.

16. The trigger sprayer of claim 1, wherein:

the means for blocking communication through the vent passage includes a first valve seat in the vent passage and a second valve seat in the vent passage and a valve element, the valve element sits over the first valve seat in response to the dispenser head being positioned in the downturned orientation, the valve element sits over the second valve seat in response to the dispenser head being positioned in the inverted orientation, and the valve element is displaced from both the first and second valve seats in response to the dispenser head being positioned in the upright orientation.

17. The trigger sprayer of claim 16, wherein:

the valve element is a ball valve.

18. A trigger sprayer for dispensing liquid from a container in an upright orientation, a downturned orientation and an inverted orientation of the trigger sprayer, the trigger sprayer comprising:

a dispenser head having a connector for connecting the dispenser head to a liquid container, the dispenser head also having a vent chamber with a vent passage extending therethrough providing venting communication between an interior of the liquid container and an exterior environment of the dispenser head and liquid container, the vent chamber containing a valve element and the vent chamber having first and second separate valve seats, the valve element moving in the vent chamber and seating over the first valve seat blocking venting communication between the container interior and the exterior environment of the dispenser head and container when the dispenser head is moved to the downturned orientation, and the valve element moving in the vent chamber and seating over the second valve seat blocking venting communication between the container interior and the exterior environment of the dispenser head and liquid container when the dispenser head is moved to the inverted orientation.

19. The trigger sprayer of claim 18, wherein:

the valve element is a ball valve.

20. The trigger sprayer of claim 18, wherein:

the dispenser head has a pump chamber therein;

a suction passage extends from the pump chamber to the container interior communicating the pump chamber with the container interior through the suction passage;

a bypass passage extends from the suction passage to the container interior communicating the suction passage with the container interior through the bypass passage, the bypass passage having a valve seat therein; and, a valve element contained in the bypass passage, the valve element moving in the bypass passage and seating over the valve seat in the bypass passage blocking communication between the suction passage and the container interior through the bypass passage in response to the dispenser head being positioned in the upright orientation and also in response to the dispenser head being positioned in the downturned orientation, and the valve element being displaced from over the valve seat in the bypass passage unblocking communication between the suction passage and the container interior through the bypass passage in response to the dispenser head being positioned in the inverted orientation.

21. The trigger sprayer of claim 20, wherein:

the valve element in the bypass passage is a ball valve.

22. The trigger sprayer of claim 1, wherein:

the dispenser head has a spray nozzle for dispensing liquid in a predetermined direction from the dispenser head; and an elongated dip tube having opposite proximal and distal ends is connected to the dispenser head at the proximal end of the dip tube, and the dip tube extends from its proximal end to its distal end in a curved configuration of the dip tube that curves toward the predetermined direction of dispensing liquid from the dispenser head.

23. The trigger sprayer of claim 18, wherein:

the dispenser head has a spray nozzle for dispensing liquid in a predetermined direction from the dispenser head; and an elongated dip tube having opposite proximal and distal ends is connected to the dispenser head at the proximal end of the dip tube, and the dip tube extends from its proximal end to its distal end in a curved configuration of the dip tube that curves toward the predetermined direction of dispensing liquid from the dispenser head.

* * * * *